US007140807B2

(12) United States Patent
Liao et al.

(10) Patent No.: US 7,140,807 B2
(45) Date of Patent: Nov. 28, 2006

(54) HYBRID COMPOSITE STEEL TENDON FOR OFFSHORE PLATFORM

(75) Inventors: Shihwei Liao, Houston, TX (US); Edward Huang, Houston, TX (US)

(73) Assignee: Deepwater Marine Technology L.L.C., Georgetown (KY)

( * ) Notice: Subject to any disclaimer, the term of this patent is extended or adjusted under 35 U.S.C. 154(b) by 0 days.

(21) Appl. No.: 11/104,825

(22) Filed: Apr. 13, 2005

(65) Prior Publication Data

US 2005/0244231 A1 Nov. 3, 2005

Related U.S. Application Data

(60) Provisional application No. 60/561,594, filed on Apr. 13, 2004.

(51) Int. Cl.
*B63B 35/44* (2006.01)
*E02B 17/00* (2006.01)

(52) U.S. Cl. ..... 405/224; 405/223.1; 405/224.2

(58) Field of Classification Search ..... 405/223.1, 405/224, 224.2, 224.3, 224.4, 195.1
See application file for complete search history.

(56) References Cited

U.S. PATENT DOCUMENTS

| | | | | |
|---|---|---|---|---|
| 5,092,713 | A * | 3/1992 | Salama | 405/224 |
| H1246 | H * | 11/1993 | Huffaker et al. | 405/223.1 |
| 5,443,330 | A * | 8/1995 | Copple | 405/224.2 |
| 5,447,392 | A * | 9/1995 | Marshall | 405/224.4 |
| 6,478,511 | B1 * | 11/2002 | Hudson et al. | 405/223.1 |
| 6,851,894 | B1 | 2/2005 | Perret | |

* cited by examiner

*Primary Examiner*—Frederick L. Lagman
(74) *Attorney, Agent, or Firm*—Bracewell & Giuliani LLP

(57) ABSTRACT

A tendon for an offshore floating platform has a tubular section formed of joints of steel pipe secured together. The tubular section has an interior sealed from sea water to provide buoyancy. A composite fiber section is secured to a lower end of the tubular section. The composite fiber section is formed of non metallic fibers and has a solid interior.

12 Claims, 2 Drawing Sheets

HYBRID COMPOSITE STEEL TENDON FOR OFFSHORE PLATFORM

CROSS-REFERENCE TO RELATED APPLICATION

This application claims priority to provisional application 60/561,594 filed Apr. 13, 2004.

FIELD OF THE INVENTION

This invention relates in general to tendons for a tension leg offshore platform, and in particular to tendons having a steel tubular portion and a separate composite fiber portion.

BACKGROUND OF THE INVENTION

One type of offshore drilling and production platform, generally called a TLP, utilizes tendons to support the platform. The tendons have lower terminations that connect to pilings on the sea floor. The upper ends connect to top connectors on the platform. The platform is de-ballasted after connection to the top connector, placing the tendons in tension.

One type of tendon consists of steel tubular joints of pipe connected together with welds or mechanical connections. The pipe has hollow interiors that are sealed from sea water to provide buoyancy. Bulkheads may be located within the interior, dividing the hollow interior in separate compartments sealed from each other. U.S. Pat. No. 6,851,894 discloses tubular sections having three different wall thicknesses. The upper section has a greater diameter but lesser wall thickness than an intermediate section, and the intermediate section has a greater diameter but lesser wall thickness than the lower section. Sealed bulkheads are not disclosed in this patent.

Another type of tether or tendon is a solid cable, preferably formed of composite fibers, such as carbon fibers. Typically, a composite tendon has an elastomeric jacket that encloses several bundles of fibers. A spacer or filler fills the interior space surrounding the fibers. Steel terminations are located on the ends of the separate rods or sections of a composite tendon for connecting the sections to each other.

Composite fiber tendons are generally smaller in diameter than steel tubular tendons and weigh less. However, they are less buoyant, such as being around 0.85 where 1.00 is considered neutral. Having solid interiors, composite fiber tendons are able to withstand high hydrostatic pressures. However, the lack of buoyancy limits the usefulness of composite fiber tendons in very deep water because a larger and more buoyant hull for the TLP is required. Also, fatigue of the upper portion of a composite fiber tendon can be a concern because of the high bending moments caused by TLP lateral motion.

As TLP platforms are located in deeper waters, providing steel tubular tendons that can resist the hydrostatic pressure becomes an increasingly difficult problem. Composite fiber tendons have an advantage of being able to resist very high hydrostatic pressure, but are heavy in water due to the lack of buoyancy.

SUMMARY OF THE INVENTION

The tendon of this invention includes a string of tubular members secured together. The tubular members have interiors sealed from sea water to provide buoyancy. A solid cable section is secured to a lower end of the string. The cable section has less buoyancy per foot and a lighter weight than the tubular members. The buoyancy of the tubular members is sufficient to provide an overall buoyancy for the tendon that is substantially neutral or slightly positive.

The cable section preferably comprises a composite fiber member made up of bundles of nonmetallic fibers. An elastomeric jacket encloses the bundles and a nonmetallic spacer surrounds the bundles within the jacket, providing a solid interior.

Preferably the string of tubular members comprises an upper portion having a greater outer diameter and lesser wall thickness than a lower portion. Sealed bulkheads are located within the interiors of the string of tubular members and spaced at intervals to provide separate compartments sealed from each other.

DETAILED DESCRIPTION OF THE INVENTION

Figure 1:
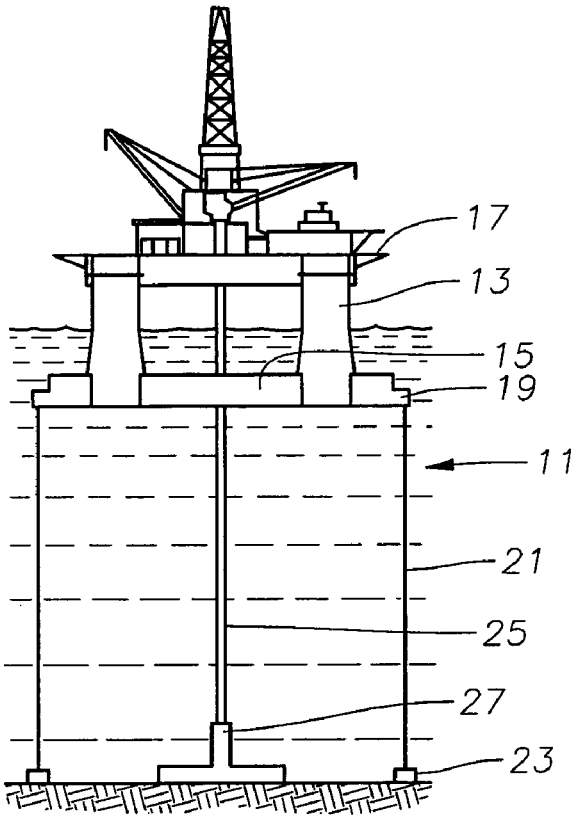
FIG. 1 is an elevational view of a floating platform having tendons constructed in accordance with this invention.

Referring to FIG. 1, floating platform 11 may be of a variety of configurations and types. In this embodiment, platform 11 is a tension leg platform having a plurality of columns 13. In this embodiment, there are four vertical columns 13, one at each corner, but different numbers could be used, such as three columns. Horizontal sections 15 extend between columns 13 in this embodiment. Columns 13 and horizontal sections 15 are hollow to provide buoyancy, and are adapted to be selectively ballasted with seawater. Platform 11 has one or more decks 17 for supporting a variety of equipment for offshore drilling and production.

Upper tendon supports 19 are mounted to platform 11 at each corner. In this embodiment, each upper tendon support 19 is located on an end of one of the horizontal sections 15. Normally, two tendons 21 are supported at each tendon support 19, thus a platform 11 with four corners would have eight separate tendons 21. The lower end of each tendon 21 is secured to a piling 23. A riser 25 is shown extending from wellhead assembly 27 to platform deck 17. Riser 25 may be a drilling riser through which a drill string extends for drilling a well. Riser 25 could also be a production riser. In that instance, a Christmas tree (not shown) may be located at the upper end of riser 25 for controlling well fluid flowing upward from riser 25. If surface Christmas trees are employed, a number of production risers 25 will extend parallel to each other from the sea floor to platform 11, each riser 25 being connected to a separate wellhead. Alternately, subsea trees could be employed.

Figure 2:
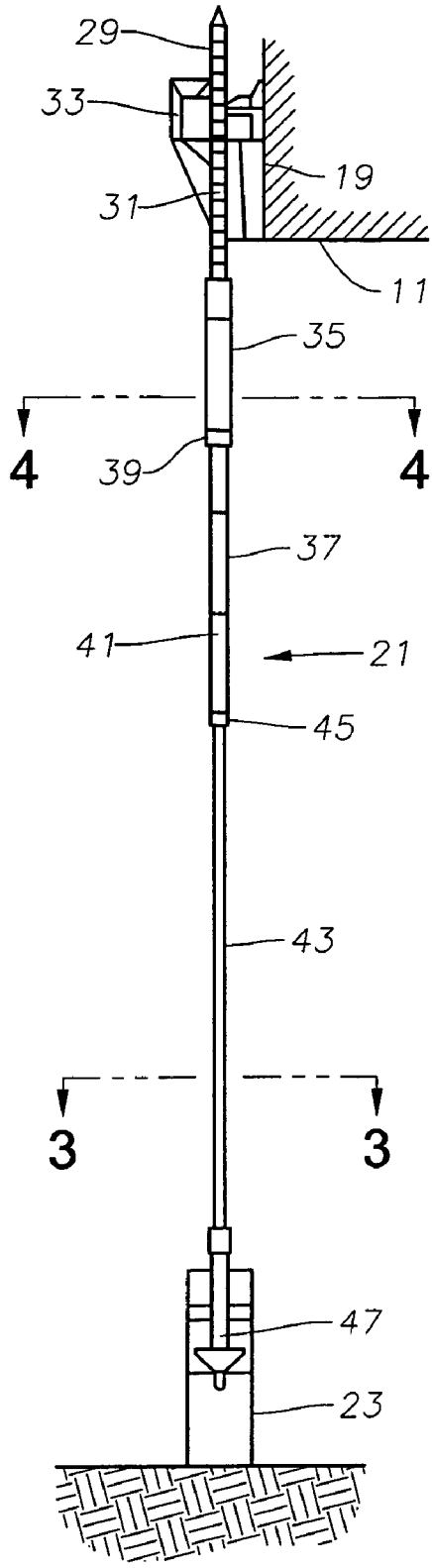
FIG. 2 is an enlarged elevational view of one of the tendons of FIG. 1.
Figure 4:
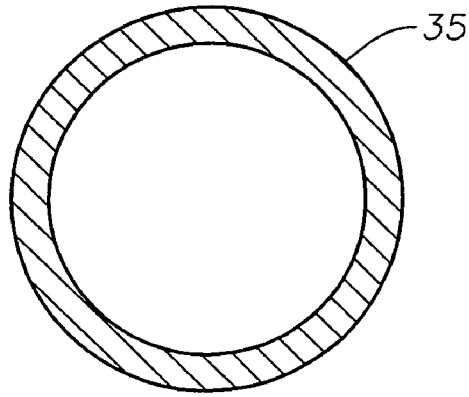
FIG. 4 is a sectional view of a steel tubular portion of the tendon of FIG. 2, taken along the line 4—4 of FIG. 2.

Referring to FIG. 2, each tendon 21 has an upper termination 29. Upper termination 29 is typically a tubular member with circumferential grooves 31 on its exterior. A top connector 33 engages grooves 31 to hold tension in tendon 21. Top connector 33 could be of a variety of conventional designs. Each tendon 21 has an upper section 35 that is a steel tubular member, as shown in FIG. 4. In this embodiment, an adapter 39 connects tendon upper section 35 to a tendon intermediate section 37. Intermediate section 37 is also a steel tubular section, but has a smaller outer diameter than upper section 35. However, the wall thickness of intermediate section 37 is greater than the wall thickness of upper section 35. Preferably the cross-sectional area through upper section 35 is substantially the same as the cross-sectional area through intermediate section 37, so as to provide uniform resistance to tensile stress throughout the length of upper and intermediate sections 35, 37 of tendon 21. Preferably upper section 35 and lower section 37 comprise joints of pipe secured together, such as by threaded ends. The joints of pipe are typically 60 to 80 feet in length.

The smaller outer diameter and thicker wall section of intermediate section 37 enhances the ability of intermediate section 37 to withstand the hydrostatic pressure, which is greater than the hydrostatic pressure acting on upper section 35. The larger outer diameter in upper section 35 increases the buoyancy of tendon 21. The increased buoyancy helps to support the weight of tendon 21, allowing for reduced platform 11 size. The lengths of upper and intermediate sections 35, 37 are selected to optimize buoyancy while maintaining the necessary strength to withstand hydrostatic pressure. Alternately, tendon upper section 35 and tendon intermediate section 37 may comprise a single section of identical diameter and wall thickness if desired.

To reduce consequences of flooding of tendon upper section 35 and intermediate section 37, a plurality of bulkheads 41 are mounted in tendon sections 35 and 37. Bulkheads 41 form sealed compartments so that leakage at any point along the length of upper section 35 or intermediate section 37 will flood only one compartment. The remaining sealed compartments would maintain sufficient buoyancy to support the weight of tendon 21. Bulkheads 41 may be placed according to the choice of the designer. They could be located at each end of each joint of pipe in upper and intermediate sections 35, 37. Alternately, they could be located at selected intervals. Bulkheads 41 may be secured in a variety of manners, and preferably are secured by welding.

Figure 3:
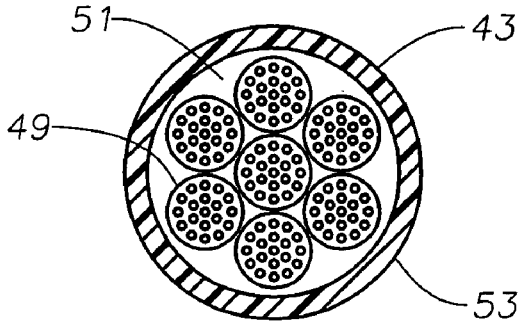
FIG. 3 is a sectional view of a composite portion of the tendon of FIG. 2, taken along the line 3—3.
Figure 5:
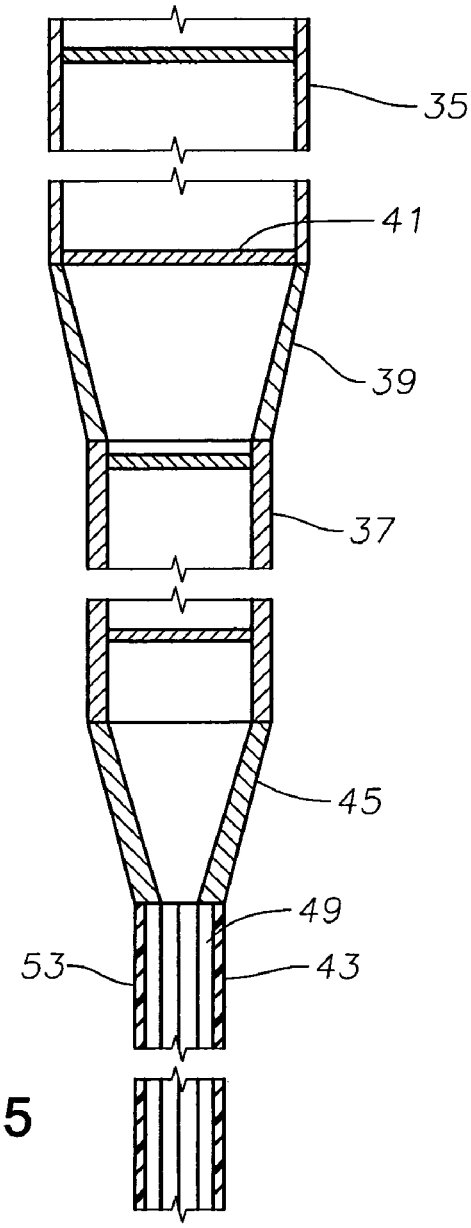
FIG. 5 is a schematic sectional view of the tendon of FIG. 2.

As shown in FIG. 2, a tendon lower section 43 extends from an adapter 45 at tendon intermediate section 37 to a bottom connector 47 that stabs into and connects with piling 23. As illustrated in FIGS. 3 and 5, tendon lower section 43 is not a hollow tubular member, rather it is a solid cable made of composite fibers. The construction of lower section 43 can vary and can be constructed in the same manner as a conventional composite fiber tendon. Preferably, tendon lower section 43 contains a plurality of longitudinally extending, parallel fibers 49 of high tensile strength non metallic material such as carbon fibers. Fibers 49 are typically located in bundles separated by a filler or spacers 51. Spacers 51 fill gaps between bundles of fibers 49 and may be of an epoxy resin material. An elastomeric jacket 53 typically surrounds the bundles of fibers 49 and spacers 51. Tendon lower section 43 is preferably made up of a plurality of separate sections fastened together. The means for connecting the separate sections of tendon lower section 43 could be the same as conventionally used with composite fiber tendons.

Being of composite fiber construction, lower tendon section 43 is lighter per foot than intermediate or upper sections 37, 35. However, because tendon lower section 43 is not hollow, it does not provide as much buoyancy as intermediate and upper sections 37, 35. The buoyancy of lower tendon section 43 by itself might only be around 85%. The lengths of intermediate and upper sections 37, 35 are selected to provide sufficient buoyancy so that tendon 21 has approximately an overall neutral or slightly positive buoyancy. One example has a buoyancy of between 0.95 to 0.97, which is slightly negative, but may be considered substantially neutral. The neutral to slightly positive buoyancy avoids any portion of tendon 21 going into compression before being connected to platform 11. Also, the buoyancy of tendons 21 allows platform 11 to place tendons 21 in tension during de-ballasting without first having to lift any significant weight of tendons 21.

Tendons 21 are installed and platform 11 deployed at a site in the same manner as conventional tendons. Tendons 21 are lowered into the sea and the lower ends latched into bottom connectors 45. Tendons 21 are self supporting, enabling platform 11 to be moved over tendons 21. Columns 13 and horizontal sections 15 are then ballasted until upper terminations 29 are attached to top connectors 33. Then columns 13 and horizontal sections 15 are de-ballasted, causing platform 11 to rise and apply the desired tension to tendons 21.

The invention has significant advantages. The hybrid tendon utilizes the advantages of steel tubular tendons and composite fiber tendons. The solid interior of the composite fiber section allows the tendon to be utilized in very deep waters. The buoyancy of the steel tubular section provides an overall suitable buoyancy, such as near neutral. Also, the steel tubular section may better withstand the high bending moments that may occur near the upper end of the tendon.

While the invention has been shown in only one of its forms, it should be apparent to those skilled in the art that it is not so limited but is susceptible to various changes without departing from the scope of the invention. For example the solid cable section of the tendons need not extend entirely to the piling, rather tubular buoyant steel members could be connected both above and below the solid cable section.

We claim:

1. A tendon for securing an offshore platform to a piling, comprising:

a string of tubular members secured together, the tubular members having interiors sealed from sea water to provide buoyancy;

a solid cable section secured to a lower end of the string; and wherein the cable section comprises:

a plurality of bundles of nonmetallic fibers;

an elastomeric jacket enclosing the bundles; and a nonmetallic spacer surrounding the bundles within the jacket.

2. The tendon according to claim 1 wherein the cable section has less buoyancy per foot and a lighter weight than the tubular members.

3. The tendon according to claim 1 wherein the overall buoyancy of the tendon is the range from substantially neutral to slightly positive.

4. The tendon according to claim 1 wherein the string of tubular members comprises:

a first portion having a greater outer diameter and lesser wall thickness than a second portion, the second portion being located below the first portion.

5. The tendon according to claim 1, wherein the string of tubular members comprises:

a first portion having a greater outer diameter and lesser wall thickness than a second portion, the second portion being located below the first portion; and a plurality of sealed bulkheads located within the interiors of the string of tubular members, providing separate compartments sealed from each other.

6. A tendon for an offshore floating platform, comprising:

an upper termination on an upper end of the tendon, the upper termination having exterior grooves for engagement by a top connector of an offshore platform;

an upper termination on an upper end of the tendon, the upper termination having exterior grooves for engagement by a top connector of an offshore platform;

a lower termination on a lower end of the tendon for connection to a piling;

a tubular section formed of joints of steel pipe secured together, the pipe having an interior sealed from sea water to provide buoyancy;

a composite fiber section secured to the tubular section, the composite fiber section being formed of non metallic fibers and having a solid interior;

wherein the fibers of the composite fiber section are grouped into bundles, and wherein the composite fiber section comprises:

an elastomeric jacket having an interior containing the bundles of fibers; and a spacer material surrounding the bundles of fibers within the interior.

7. The tendon according to claim 6, wherein the composite fiber section weighs less and has less buoyancy per foot than the tubular section.

8. The tendon according to claim 6, wherein the composite fiber section has less buoyancy per foot than the tubular section, and the buoyancy of the tubular section is selected to provide an overall buoyancy for the tendon that is substantially in the range from 0.95 to 0.97.

9. The tendon according to claim 6, wherein the composite fiber section is located below the tubular section.

10. The tendon according to claim 6 wherein the tubular section comprises:

a first portion having a greater outer diameter and lesser wall thickness than a second portion, the second portion being located below the first portion; and a plurality of sealed bulkheads located within the interiors of the first and second portions, providing separate compartments sealed from each other.

11. An apparatus for performing offshore hydrocarbon extraction operations, comprising:

a floating platform;

a tendon secured to the platform for connection in tension to a piling on a sea floor;

the tendon having a tubular section formed of joints of steel pipe secured together, the pipe having a hollow interior sealed from sea water;

the tendon having a composite fiber section secured to a lower end of the tubular section, the composite fiber section being formed of bundles of non metallic fibers and having a solid interior;

the tubular section having a greater buoyancy per foot than the composite fiber section; and the buoyancy of the tubular section being sufficient to provide an overall substantially neutral to slightly positive buoyancy for the tendon.

12. The tendon according to claim 11, wherein the tubular section comprises:

a first portion having a greater outer diameter and lesser wall thickness than a second portion, the second portion being located below the first portion; and a plurality of sealed bulkheads located within the interiors of the first and second portions, providing separate compartments sealed from each other.

* * * * *